US006109997A

United States Patent [19]

Hatting

[11] Patent Number: 6,109,997

[45] Date of Patent: Aug. 29, 2000

[54] TOY BUILDING SET COMPRISING A NUMBER OF TRANSMISSION ELEMENTS

[75] Inventor: Jan Hatting, Vejle, Denmark

[73] Assignee: INTERLEGO AG, Baar, Switzerland

[21] Appl. No.: 09/154,923

[22] Filed: Sep. 17, 1998

[51] Int. Cl.[7] ..... A63H 33/12

[52] U.S. Cl. ..... 446/103

[58] Field of Search ..... 446/102, 103, 446/104, 105; 434/401

[56] References Cited

U.S. PATENT DOCUMENTS

| | | | |
|---|---|---|---|
| 2,406,759 | 9/1946 | Glukes | 446/103 |
| 3,597,874 | 8/1971 | Ogsbury | 446/104 |
| 3,638,352 | 2/1972 | Christiansen | 446/102 |
| 3,648,404 | 3/1972 | Ogsbury et al. | 446/104 |
| 4,078,328 | 3/1978 | Rayment | 446/102 |
| 5,071,384 | 12/1991 | Poulsen | 446/103 |
| 5,094,643 | 3/1992 | Bolli et al. | 446/102 X |
| 5,890,943 | 4/1999 | Poulsen et al. | 446/103 |

*Primary Examiner*—D. Neal Muir

*Attorney, Agent, or Firm*—Pitney, Hardin, Kipp and Szuch LLP

[57] ABSTRACT

A toy building set comprising a number of transmission elements in the form of a plurality of shafts and a plurality of toothed wheels, and a number of supporting elements for embedding of said transmission elements; and wherein the shafts have shaft extremities that are provided with splines in the form of a number of grooves spaced equally apart for mounting of one or more toothed wheels; and said toothed wheels having a central opening for receiving the spline of the shaft; and wherein the central opening on the toothed wheels is configured with one or more protruding flanges that engage with one or more of the grooves on the spline of the shaft with a view to ensuring that a toothed wheel mounted on a shaft is unable to rotate relative to the shaft; and wherein the toothed wheels are provided with a number of teeth that corresponds to or is equal to an entire multiple of the number of grooves on the spline of the shaft which makes it very easy to correctly mount the toothed wheels on the associated shafts.

8 Claims, 4 Drawing Sheets

TOY BUILDING SET COMPRISING A NUMBER OF TRANSMISSION ELEMENTS

BACKGROUND OF THE INVENTION

1. Field of the Invention

The present invention relates to a toy building set comprising a number of shafts and a number of toothed wheels, and wherein the shafts are provided with splines for mounting of one or more toothed wheel(s), said toothed wheels having a central opening for receiving the spline of the shaft, and wherein the central opening of the toothed wheels is configured with one or more protruding flanges that engage with one or more of the grooves on the shaft's spline in order to ensure that the toothed wheels mounted on a shaft are unable to rotate relative to said shaft, and wherein the toothed wheels have a number of teeth which corresponds to an entire multiple of the number grooves on the shaft's spline.

2. Description of the Prior Art

Such toy building sets are often combined with a view to building model cranes, cars, machines or other devices in which shafts and toothed wheels are used to form a variety of gear functions and movement functions in the finished model.

In case of conventional gear functions where an input shaft can eg be rotated as much as an infinite number of times about its longitudinal axis, and wherein the sole purpose of the gear transmission is to rotate an output shaft a number of times which is proportional to the input shaft, most frequently correct mounting of shafts and toothed wheels presents no problems, but in situations where the input shaft and output shaft of the gear are connected to functional elements in the toy building set, and where these functional elements are required to have an entirely specific mutual pattern of movement, increased requirements are made to the mounting of a gear by use of the individual toothed wheels and shafts.

Therefore, in particular in connection with these latter toy building sets, building manuals are often included to instruct the user how to build individual models. It is a frequent problem with these manuals to ensure that the user is in fact capable of building the model in such a manner that the functions of the finished model corresponds to the intentions of the manufacturer.

As mentioned above, this is a problem in particular in the construction of models where it is a precondition for obtaining a satisfactory functioning of the toy that gear elements, if any, in the toy building set are correctly assembled, since it is difficult to clearly indicate in the building manual the orientation of a relevant toothed wheel relative to the shaft on which it is mounted to ensure that the toy model functions correctly. In that case, it requires much of the building manual and of the user who is to understand it.

U.S. Pat. No. 2,406,759 describes a toothed wheel for use with toys with which this problem is solved, the toothed wheel shown being provided with four teeth and a square opening for receiving a shaft. Hereby it is made impossible that the toothed wheel is mounted incorrectly on the shaft, which means that gear connections will always be assembled correctly without making substantial requirements to the user or the building manual, while simultaneously avoiding the need for special pairs of associated shafts and toothed wheels, which would reduce the flexibility of the toy and optionally entail increased production costs for the toys.

However, it is a problem with the transmissions that can be built in connection with such toothed wheels that, on the one hand, it is desired to have relatively few teeth and grooves on the toothed wheels and the shafts and, on the other hand, to obtain small wear on the tooth surfaces and an evenly rotating transmission.

OBJECTS AND SUMMARY OF THE INVENTION

In the light of this, it is the object of the present invention to provide a toy building set that accomplishes the advantages obtained by the known system according to U.S. Pat. No. 2,406,759 while simultaneously obtaining an improved resistance to wear and a more even transmission by use of the toothed wheels. As featured in claim 1, this is obtained in that the substantially barrel-shaped tooth is configured with a circular-cylindrical surface which is, at both ends of the substantially barrel-shaped tooth, extending into a substantially spherical surface.

Particularly advantageously, the toy building set comprises at least two shafts and two toothed wheels of the above-mentioned type, since it is hereby possible to obtain transmission systems with an input shaft and an output shaft with 1-to-1 transmission without an ensuing risk that the wrong toothed wheel is arranged incorrectly on one of the shafts with ensuing incorrect transmission.

In a preferred embodiment, it is preferred that the shafts are configured with a spline comprising a total of four grooves, and that at least some of the toothed wheels in the toy building set have the same number of teeth.

Further advantageously, the spline on the shafts and the central wheel on the toothed wheels are so configured that they form a frictional coupling, thereby allowing the toothed wheels to be displaced on the shafts as this results in a particularly simple mounting.

Particularly advantageously, the toothed wheels are made with a hub that encloses the central opening in the toothed wheel, and wherein a spoke is arranged around the hub for carrying each tooth on the toothed wheel, said spokes extending substantially radially from the hub of the toothed wheel; and at the outer extremity of the spoke, a barrel-shaped tooth is arranged which is substantially circular-cylindrical about a axis of symmetry whereby the axis of symmetry of the barrel-shaped tooth becomes parallel with the axis of rotation of the toothed wheel; and wherein the spoke has a transversal dimension in the tangential direction relative to the hub of the toothed wheel that is smaller that the transversal dimension of the barrel-shaped tooth in the same direction. Thereby the barrel-shaped tooth forms an abutment surface which is suitable for forming transmission with parallel axes as well as transmissions with perpendicular shafts.

In this context, the substantially barrel-shaped tooth is particularly advantageously configured with a circular-cylindrical surface which, at both ends of the substantially barrel-shaped tooth, extends into a substantially spherical surface. Thereby the forces in the axial direction of the toothed wheel are reduced to a minimum during use.

Furthermore the toy building set can advantageously be so configured that, in the areas between the individual barrel-shaped teeth, the spokes form a substantially concave circular abutment surface relative to the hub of the toothed wheel, in such a manner that the outer periphery of the toothed wheel, relative to the hub, consists of combined convex circular abutment surfaces that are formed by the teeth, and there between circular concave abutment surfaces formed by the spokes, and wherein the radius of rounding is the same for the convex abutment surfaces as for the concave abutment surfaces. Thereby a very large abutment surface is formed between individual toothed wheels in a given transmission which results in the wear being reduced to a minimum.

The concave circular abutment surfaces can furthermore advantageously be configured in such a manner that they have a radius of rounding with a centre of rotation, and wherein the distance from the centre in the central opening in the toothed wheel and to said centre of rotation is shorter than the distance from the centre of the central opening in the toothed wheel to the axis of symmetry of the teeth. Thereby toothed wheels with associated shafts can be arranged extremely close to each other without the relatively large teeth disfavouring this.

If the spherical surfaces at the ends of the substantially barrel-shaped teeth are made to have a radius of rounding that corresponds to the radius of rounding of the concave abutment surfaces formed by the spokes, advantages corresponding to those mentioned above will result, only with the toothed wheels being used in a transmission where the shafts are arranged substantially perpendicular to each other.

DESCRIPTION OF THE DRAWINGS

The invention will now be described in further detail with reference to the drawings, wherein.

DETAILED DESCRIPTION OF THE PREFERRED EMBODIMENT

Figure 1:
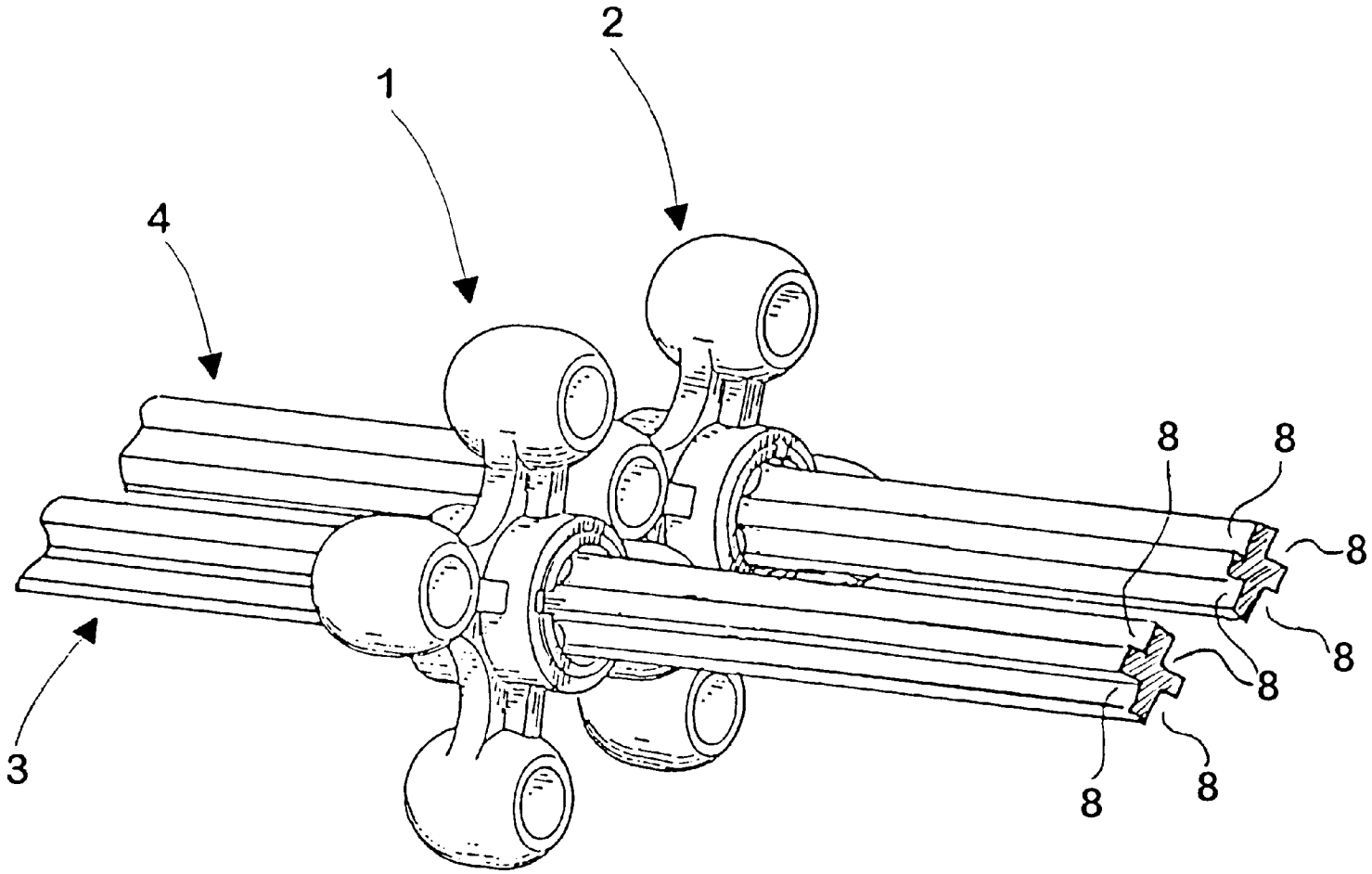
FIG. 1 is a perspective view of a transmission made of two toothed wheels and two shafts according to the present invention.

Thus, FIG. 1 shows a transmission made of two toothed wheels 1,2 that are in engagement with each other and mounted on two shafts 3,4 that can be rotatably embedded about their longitudinal axis in a (not shown) supporting structure. In this manner the shafts 3,4 and the toothed wheels 1,2 form a transmission with eg an input shaft and an output shaft.

As will appear, the shafts are configured as elongate profiles having, at any place, a cross-section in the form of a cross whereby such shafts can be designated cross shafts. Thus, this cross forms a spline with four grooves 8 that can conventionally be used to prevent the toothed wheels 1,2 from rotating relative to the shafts 3,4 about the longitudinal direction of the shafts.

Figure 2:
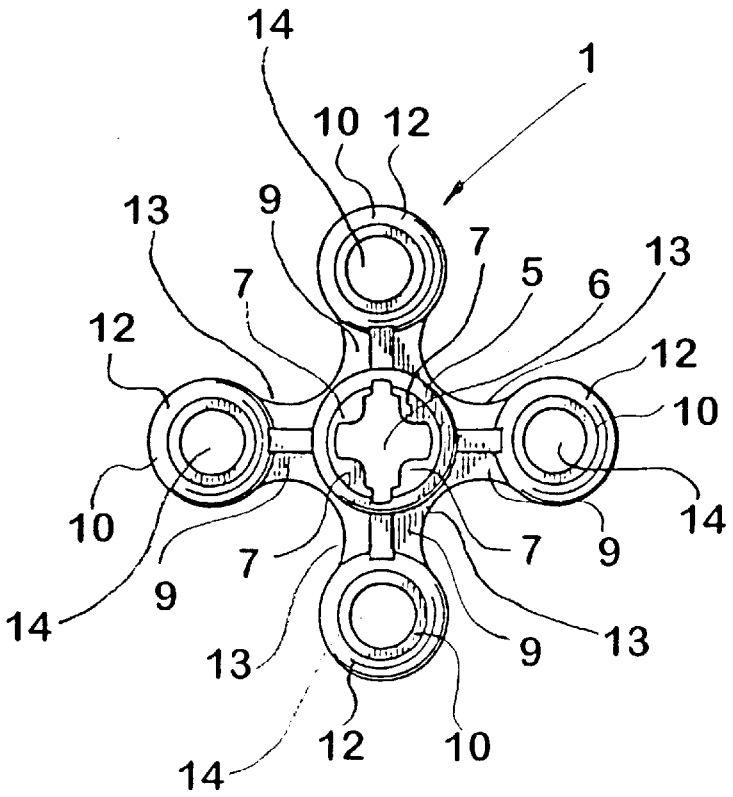
FIG. 2 is a front view of one of the toothed wheels according to FIG. 1.

It will thus appear from FIG. 2 that the toothed wheel 1 has a centrally arranged hub 5 in which a central opening 6 is configured which has four inwardly protruding flanges 7. These flanges 7 are arranged to allow each of the flanges 7 on the toothed wheel, when the toothed wheel 1 is—as will appear eg from FIG. 1—mounted on a shaft 3, extend into one of the grooves 8 on the shaft 3 whereby the toothed wheel 1 is prevented from rotating relative to the shaft 3.

The four flanges 7 on the toothed wheel 1 and the four grooves 8 on the shaft 3 being spaced equally apart, the toothed wheel 1 can be mounted on the shaft 3 with four different orientations relative to the shaft 3. This makes it extremely simple to carry out correct mounting. According to the invention the toothed wheel 1 is made with the same number of teeth as the number of grooves on the shaft, viz four.

This will be apparent from FIG. 2 by the toothed wheel 1 having four spokes 9, each of which carries a tooth 10. The fact that there are exactly four teeth 10 on the toothed wheel 1 and the toothed wheel 1 being, as a consequence of the configuration of the grooves 8 on the shaft 3 and the grooves 7 on the toothed wheel 1, mountable only with four different orientations on the shaft 3 means that it is ensured that, irrespectively of the way in which the toothed wheel 1 is mounted on the shaft 3, the result will be the same with respect to the location of the teeth relative to the shaft, which means that functionally there will be no difference whether the toothed wheel is mounted in one way or the other.

This means that extremely low demands are made to the correct mounting of a toothed wheel 1,2 on a shaft 3,4. In the preferred embodiment, as will appear in particular in FIG. 3, the toothed wheel 1 is symmetrical around a plane perpendicular to its axis of rotation which means, to an even higher degree, that it does not matter whether, upon mounting on the shaft 3 as shown in FIG. 1, the toothed wheel 1 faces one way or the other, since there will be no difference as to functionality between the two orientations. In the preferred embodiment the toothed wheel 1 can thus be mounted in eight different ways on the shaft 3 without this having any bearing on the function thereof in a fully assembled toy building set. Thus, it is completely impossible to mount the toothed wheel 1 incorrectly on the shaft 3 which means that extremely low demands are made to the mounting and a building manual, if any.

Obviously, a toy building set may include different shafts with different numbers of grooves and associated toothed wheels with a corresponding number of teeth, but in accordance with the preferred embodiment as shown in FIG. 1, the building set includes only identical toothed wheels 1,2 and shafts 3,4 with the same number of grooves for forming a given transmission, since it is hereby of no consequence whether a given toothed wheel 1,2 is mounted in on one shaft 3,4 or the other. Thus, this presupposes that the toy building set has at least two identical toothed wheels and two shafts with the same number of grooves.

Figure 4:
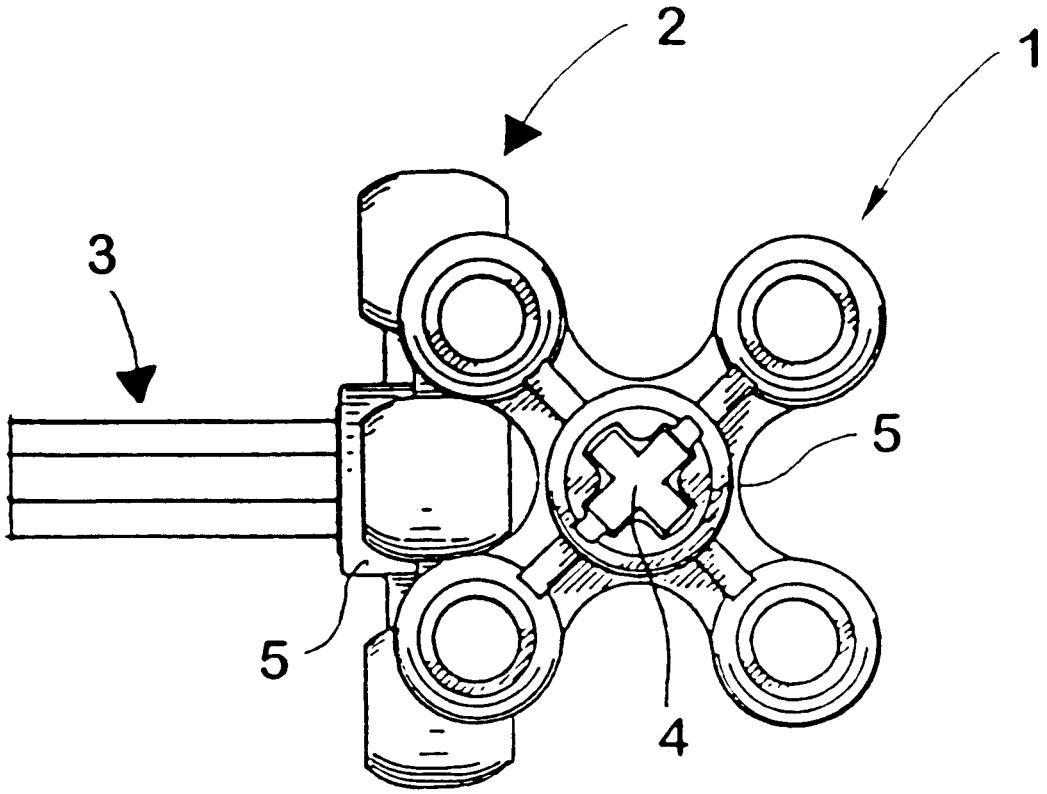
FIG. 4 illustrates a transmission in the form of an angle gear made of two shafts and two of the toothed wheels shown in FIGS. 2 and 3.
Figure 5:
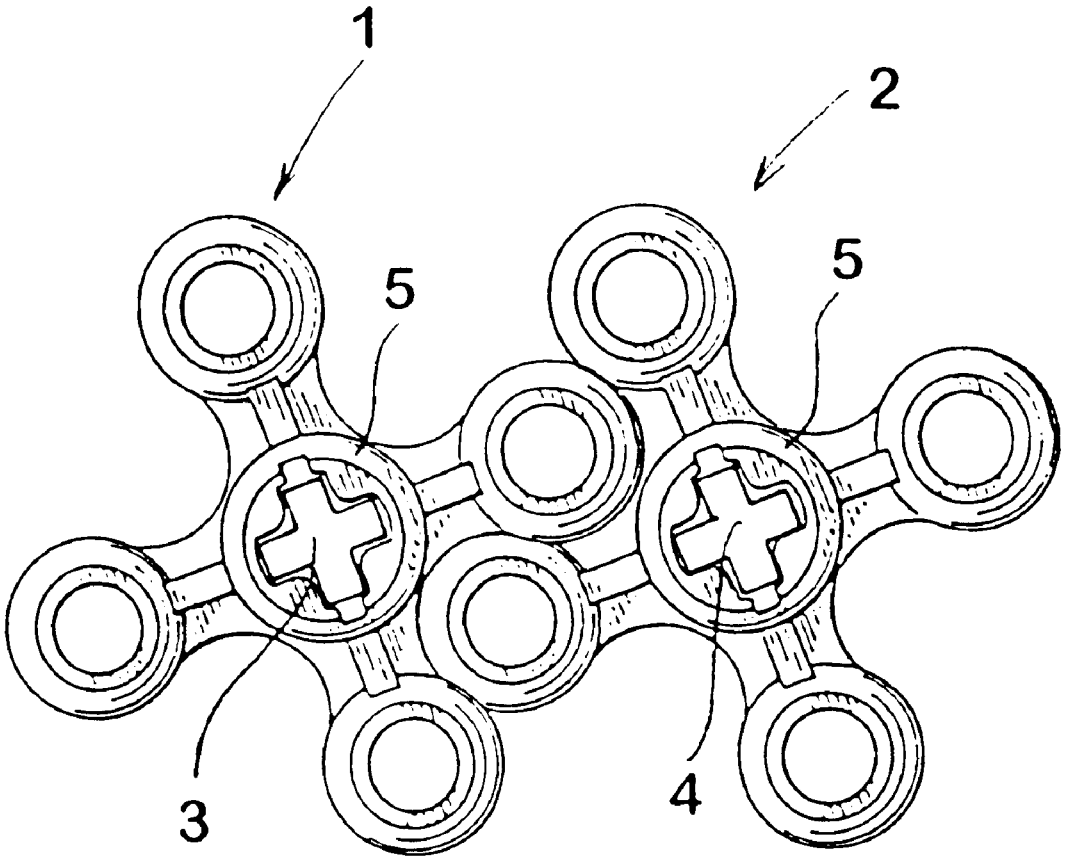
FIG. 5 is a front view of the transmission shown in FIG. 1.

In the preferred embodiment according to the invention the toothed wheels 1,2 are furthermore of such configuration that they can conveniently form angle gear as will appear from FIG. 4 as well as gear in which the toothed wheels 1,2 are arranged in the same plane as exemplified in FIG. 1 or 5 while simultaneously accomplishing a reasonably vibration-free running of such transmission.

Figure 3:
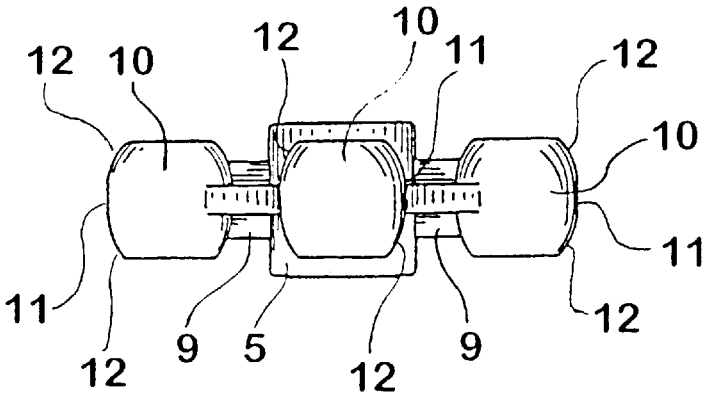
FIG. 3 is a lateral view of the toothed wheel according to FIG. 2.

This is obtained by the toothed wheels 1,2 being configured as shown in FIGS. 2 and 3. From this, it will be seen that each tooth is configured with a substantially barrel-shaped surface comprising a circular-cylindrical surface 11 which will, on each side of the toothed wheels, extend into a spherical surface 12. Additionally the spokes 7 that carry each of the teeth are configured as a surface 13 which is concave relative to the hub 5.

The radii of rounding being identical for the circular-cylindrical surfaces 11 of the teeth and the spherical surfaces 12 as well as for the concave surfaces 13 configured on the spokes, two toothed wheels 1,2 can, as will appear from FIGS. 4 and 5, be mounted on the shafts 3,4 so as to form either an angle gear as shown in FIG. 4 or a planar gear as shown in FIG. 5.

Thus, the described configurations of the circular-cylindrical surfaces 11, the spherical surfaces 12 and the concave surfaces 13 enable a relatively continuously extending abutment surface in all mutual positions of the toothed wheels, despite the fact that on the toothed wheels 1,2 four teeth 10 alone are situated, and despite the face that the hubs 5 on the toothed wheels 1,2 are arranged very close to each other. This results in a gearing essentially without discontinuities in the gear transmission.

In this context, the teeth 10 are particularly advantageously provided with a central opening 14 whereby an even surface on the teeth 10 is ensured eg by injection moulding of the toothed wheel in plastics, during which—in the absence of such central opening 14—there would be a risk of suctions in the surfaces 11,12 of the teeth.

As will appear from all of the above figures, no special elements are provided for axially securing the toothed wheels 1,2 on the shafts 3,4. This is due to the fact that the toothed wheels 1,2 are configured with flanges 7 that are in frictional abutment on the grooves 8 in the surface of the shafts 3,4 whereby the toothed wheels 1,2 are mounted on the shafts 3,4 exclusively by frictional shifting of the shafts 3,4 into the central opening of the hub 5 on the toothed wheels 1,2. In particular, but not exclusively, in case of the planar gear as shown in FIGS. 1 and 5, the circular-cylindrical surface 11 on the teeth 10 serves to ensure that to the widest extent possible, axial forces on the toothed wheels 1,2 are avoided during load on the transmission, whereby it is ensured to a reasonable degree that such axial forces may cause the toothed wheels 1,2 to be shifted on the shafts 3,4 during use.

Obviously, toothed wheels and shafts can be configured in other ways than the preferred embodiment shown in the figures. Thus the shafts can have another number of grooves than the four shown herein which will entail, however, that the toothed wheels are to have a corresponding number of teeth. Moreover the toothed wheels can be configured as more conventional toothed wheels with teeth that are configured eg in such a manner that they form surfaces that roll across each other during the gear transmission instead of surfaces that slide across each other as is the case with the shown toothed wheels 1,2.

Moreover, it is not necessary for the shafts to have grooves throughout their entire lengths as illustrated eg in FIG. 1 but they may have grooves only at their ends where mounting of a toothed wheel is contemplated.

Nor is there any need for the toothed wheel to be provided with flanges 7 in a number that corresponds to the number of grooves on the shafts 3,4, but it is certainly possible that there is only one flange 7 to ensure that the toothed wheel 1,2 cannot rotate relative to the shaft 3,4.

What is claimed is:

1. A toy building set comprising a number of transmission elements in the form of a plurality of shafts and a plurality of toothed wheels and wherein the shafts have shaft ends that are provided with splines in the form of a number of grooves spaced equally apart for mounting of one or more toothed wheels, and said toothed wheels having a central opening for receiving the spline end of the shaft, and wherein the central opening on the toothed wheels is configured with at least one protruding flanges that engage in one of the grooves on the spline of the shaft with a view to ensuring that a toothed wheel mounted on a shaft cannot rotate relative to the shaft, and wherein the toothed wheels are provided with a number of teeth corresponding to or being an integer multiple of the number of grooves on the spline of the shafts, characterized in that the toothed wheels are configured with a hub that encloses the central opening on the toothed wheel, and wherein a spoke for each tooth on the toothed wheel is arranged around the hub, said spokes extending substantially radially from the hub of the toothed wheel, and having an outer extremity carrying a barrel-shaped tooth which is substantially circular-symmetrical about an axis of symmetry, whereby the axis of symmetry of the barrel-shaped tooth is parallel with the axis of rotation of the toothed wheel.

2. A toy building set according to claim 1, characterized in that the toy building set comprises at least two shafts and two toothed wheels.

3. A toy building set according to claim 1, characterized in that the shafts are provided with a spline comprising a total of four grooves, and that at least some of the toothed wheels in the toy building set have the same number of teeth.

4. A toy building according to claim 1, characterized in that the spline on the shafts and the central opening on the toothed wheels are configured to form a frictional coupling thereby allowing the toothed wheels to be shifted on the shafts.

5. A toy building set according to claim 1, characterized in that the substantially barrel-shaped tooth is configured with a circular-cylindrical surface extending at both extremities of the substantially barrel-shaped tooth into a substantially spherical surface.

6. A toy building set according to claim 1, characterized in that the spokes in the areas between the individual barrel-shaped teeth form a circular abutment surface which is substantially concave relative to the hub of the toothed wheel in such a manner that the outer periphery of the toothed wheel, relative to the spoke, consists of combined, convex circular abutment surfaces that are formed of the teeth, and there between circular concave abutment surfaces formed by the spokes; and wherein the radii of rounding are the same for the convex abutment surfaces and the concave abutment surfaces.

7. A toy building set according to claim 6, characterized in that the concave circular abutment surfaces are arranged in such a manner that they have a radius of rounding with a centre of rotation; and wherein the distance from the centre in the central opening in the toothed wheel and said centre of rotation is less than the distance from the centre of the central opening in the toothed wheel and to the axis of symmetry of the teeth.

8. A toy building set according to claim 6, characterized in that the spherical surfaces at the ends of the substantially barrel-shaped teeth are configured to have a radius of rounding that corresponds to the radius of rounding for the concave abutment surfaces formed by the spokes.

* * * * *